US008770275B2

(12) United States Patent
Mullins

(10) Patent No.: US 8,770,275 B2
(45) Date of Patent: Jul. 8, 2014

(54) FILL UP AND CIRCULATING TOOL WITH WELL CONTROL FEATURE

(76) Inventor: Albert A. Mullins, Boling, TX (US)

( * ) Notice: Subject to any disclaimer, the term of this patent is extended or adjusted under 35 U.S.C. 154(b) by 343 days.

(21) Appl. No.: 13/223,002

(22) Filed: Aug. 31, 2011

(65) Prior Publication Data

US 2012/0080182 A1 Apr. 5, 2012

Related U.S. Application Data

(60) Provisional application No. 61/389,552, filed on Oct. 4, 2010.

(51) Int. Cl.
*E21B 19/00* (2006.01)

(52) U.S. Cl.
USPC ..... 166/90.1; 166/154; 166/77.1

(58) Field of Classification Search
USPC ..... 166/90.1, 77.1, 154
See application file for complete search history.

(56) References Cited

U.S. PATENT DOCUMENTS

| | | | | |
|---|---|---|---|---|
| 5,735,348 | A | 4/1998 | Hawkins, III | |
| 5,971,079 | A | 10/1999 | Mullins | |
| 6,309,002 | B1 | 10/2001 | Bouligny | |
| 7,568,522 | B2 * | 8/2009 | Boutwell et al. | 166/250.01 |
| 7,694,744 | B2 | 4/2010 | Shahin | |
| 2008/0099196 | A1 | 5/2008 | Latiolais et al. | |
| 2012/0048574 | A1 * | 3/2012 | Wiens et al. | 166/387 |

* cited by examiner

*Primary Examiner* — William P Neuder
(74) *Attorney, Agent, or Firm* — Steve Rosenblatt

(57) ABSTRACT

A high-pressure casing fill-up and circulating assembly and method of use is disclosed. The fill and circulating assembly, when inserted into the uppermost portion of the casing, will allow the casing to be filled while each section of casing is added. In one configuration there can be a cup type seal that seals in the casing simply by inserting the circulator into the casing. In yet another configuration the casing circulator portion can be anchored in the casing by manipulating the setting apparatus of the circulator thus anchoring the circulator to the casing and a settable seal unit will be energized to seal between the casing and the circulator.

14 Claims, 4 Drawing Sheets

FILL UP AND CIRCULATING TOOL WITH WELL CONTROL FEATURE

CROSS REFERENCE TO RELATED APPLICATION

This application is claims priority from U.S. Provisional Patent Application Ser. No. 61/389,552 for "Fill Up and Circulating Tool", filed on Oct. 4, 2010, the disclosure of which is incorporated herein by reference in its entirety.

FIELD OF THE INVENTION

The field of this invention relates to filling casing while it is being run in the hole and circulating it to aid in its proper positioning as it is being advanced into the wellbore.

BACKGROUND OF THE INVENTION

Casing for a wellbore that has just been drilled is assembled at the surface as joints are added and the string is lowered into the wellbore. As the joints are added at the surface on the rig floor, it is desirable to fill the casing. Filling the casing before it is run into the wellbore prevents pressure imbalances on the casing as it is being advanced into the wellbore. Additionally, once the casing is filled, it may be desirable to circulate through the casing as it is being run into the wellbore. Devices used in the past are illustrated in U.S. Pat. Nos. 5,735,348 and 5,971,079.

The devices illustrated in these patents provide the means of filling and circulating the casing but do not address the issue of handling high-pressure circulation or control of the well since the force caused by high-pressures can buckle the pipe member holding the circulator in place or exceeding the load limit of the hoisting system, bails or elevator supporting the casing. In addition when the casing is filled, the seal will not allow the air trapped in the casing to escape. This results in pressurizing the casing as each section is filled. This results in well fluid (normally mud) being expelled when the seal is removed from the casing resulting in a dangerous eruption of mud and air which can injure personnel, damage equipment or cause environmental damage. Additionally, there is no method of isolating pressure from the rig mud system or allowing a high-pressure connection to be made other than the rig system and there is also no means to access the wellbore by wireline, coiled tubing or other means.

Accordingly, it is an objective of one configuration of the present invention to provide a means of isolating the high load from the pipe member holding the circulator in place or the hoisting system, bails and elevator supporting the casing. In addition, the seal will not be energized during normal filing operations, which will prevent pressurizing the casing as each section is filled. It is another objective of the present invention to provide a method of isolating the high-pressure, which may be used to circulate or control the well from entering the rig piping system. In addition a method is disclosed for controlling the pressure in the casing while providing a means of connecting a high-pressure mud system to the casing. A method is provided of disconnecting the rig hoisting system to provide access the wellbore. Another objective of the present invention is to provide additional means of sealing between the casing and circulator and to provide access to the wellbore by wireline, coiled tubing or other means.

In yet another configuration of the invention a means of sealing between the casing and the assembly is disclosed whereby flow of mud (flow-back) from the well can be routed to the rig mud system while each section of casing is lowered into the well. In this configuration it is possible to provide a means of setting the anchor system should the pressure in the casing exceed a pre-set value. In this configuration the apparatus disclosed can also be set remotely by use of a control system near or on the rig floor.

The invention allows a safe method of handling high-pressure that is a more environmentally friendly way of filling and circulating a casing as it is being run in the well.

SUMMARY OF THE INVENTION

A hydraulically controlled circulator assembly is disclosed, having a seal for sealing engagement with the casing to allow well fluids to be under pressure control, and an anchor system (slips) to engage the casing and to anchor the circulator to the casing. Hydraulic control lines/hoses are connected to the upper end of the circulator and on their opposite ends attached to a hydraulic control system at the rig floor. The circulator is supported and positioned in the casing by the rig top drive or rig traveling block in the case of a rotary type rig.

In its deactivated position the circulator anchor system (slips) will be in a retracted position so that it will not engage the casing. When activated the seal and anchor will engage the casing to prevent hydraulic loads generated below the circulator by pressure acting on the casing internal area from loading the rig hoist system, bails and elevators.

Two configurations of a fill and circulation tool are disclosed:

In a first configuration, the circulator seal and anchor will remain retracted using pressure applied to one control line/hose until actuated by use of the hydraulic control system through the second line/hose.

In a second configuration, a cup type seal is in sealing engagement as the circulator is inserted into the casing. The anchor system will be retracted during the insertion process using a constant pressure supplied by one control line/hose through the hydraulic control system. When pressure increases in the casing the anchor and an additional seal will engage the casing to seal in the casing and hold the circulator in place such that the load being generated by the pressure acting on the casing internal area will be restrained by the casing and not by the rig hoisting system or the bails and elevator holding the casing.

In both configurations of the circulator, the assembly will also consists of a pair of safety valves spaced above the circulator assembly and separated by a side entry port. At least one of the safety valves is used to isolate the high-pressure in the casing from entering the rig mud system that is not capable of withstanding such pressures. The side entry port is provided such that a high-pressure connection can be made to a pumping system capable of withstanding pressures much greater than that handled by the rig.

A method of controlling well pressure and isolating the well pressure from the rig mud system is disclosed. A method of accessing the well with wireline, coiled tubing or other means is also disclosed.

Several sealing methods and setting methods are disclosed. Other features comprise:

1. A circulator that has at least one cup seal and one packer type seal for sealing in a tubular to withstand relatively low pressure for taking flow from the casing or circulating; and to be anchored to the casing to take high pressure and preventing the excessive loading of the rig handling system (top drive or hook, bails and elevator).
2. A circulator that fills the casing as each section is added while allowing air in the sections added to escape.

3. A circulator that anchors to the casing and sealing in the casing to withstand high-pressure and preventing the excessive loading of the rig handling systems.
4. A circulator that holds the entire load created by pressure in the casing.
5. A circulator assembly that allows releasing the rig hoisting and mud system when the circulator is holding pressure.
6. A method of isolating the rig mud system from the high-pressure.
7. A method of isolating the rig mud system from high pressure and connecting to the casing using high pressure pump or control systems.
8. A method of entering the wellbore through the Fill-up and Circulating assembly while under pressure.

DETAILED DESCRIPTION OF PREFERRED EMBODIMENT

Figure 1:
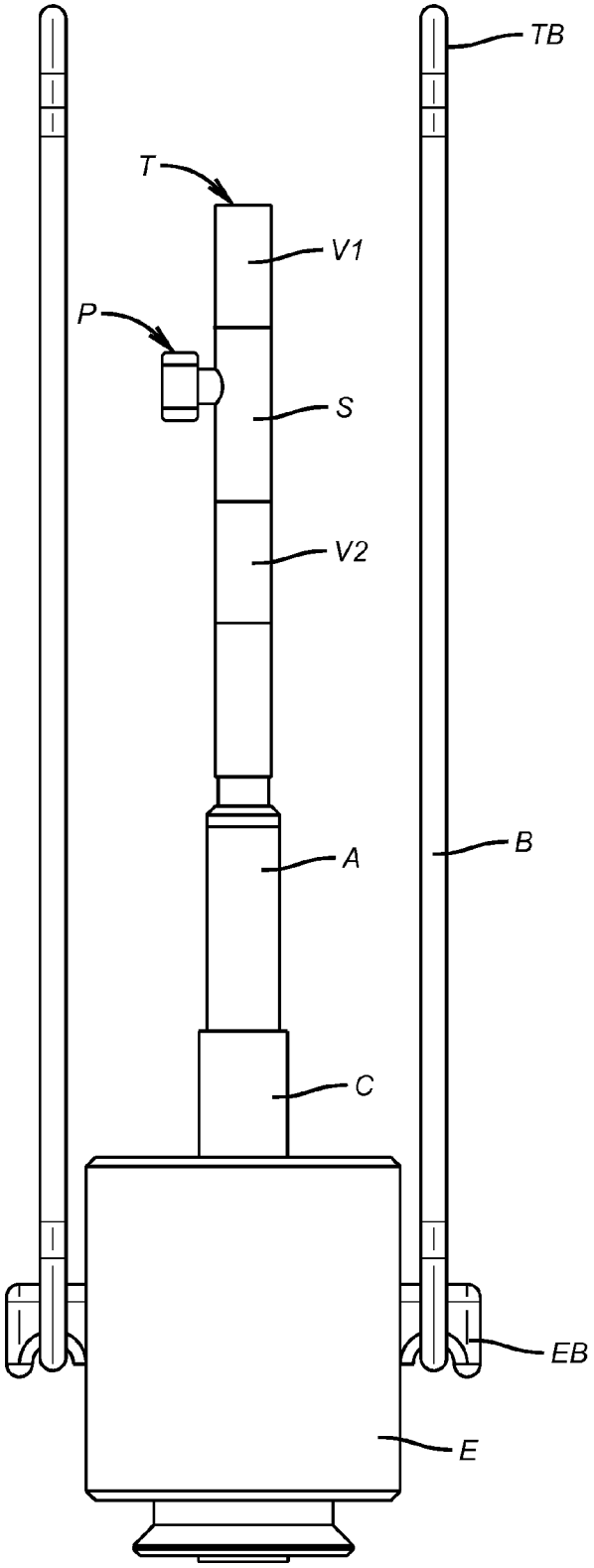
FIG. 1 is an overall view of the assembly and a rig Elevator E as is would be assembled on the rig.

The fill-up and circulating assembly A is shown in FIG. 1 with its other components, a lower safety valve V2, which is normally open, side entry port S, which is normally closed with a cap assembly P, and an upper safety valve V1, which is normally open. These components of the complete assembly are shown along with an elevator E for supporting the casing C, the upper extreme of the upper safety valve V1 would be attached to a top drive (not shown) and rig mud system at T. The elevator E would be supported by bails B at EB. The bails are attached to the top drive or hook at TB.

This is the preferred embodiment but other configurations of the assembly are apparent to those familiar with the art. In other words, if the assembly were attached to a rotary rig, the upper safety valve V1 would be closed or a blank sub would be in its place and attached to an adapter (not shown) at T, the adapter would be attached to the block for supporting the circulator and the rig mud system would be attached to the side entry sub S at port P, an isolation valve would normally be attached at the port P of the side entry sub to allow the relatively low pressure mud system to be disconnected and a high pressure control or pumping system to be attached.

The safety valves V1 and V2 and side entry sub S are not necessary for the function of the fill and circulating assembly A but do provide a great deal of safety in controlling a well during a kick since the normally low pressure rig mud system can be isolated from the kick and high pressure hoses and pumps can be attached to side entry S at port P.

Should pressures be encountered that would place the rig mud system in an unsafe condition, the two safety valves V1 and V2 would be immediately closed. This will isolate the casing pressure from the rig mud system. The cap P would be removed from the side entry port S. A high pressure hose or piping (not shown) would be attached to the side entry port S at P. The high pressure hose or piping would then be attached to a high pressure pumping and well control system. Valve V2 can then be opened to provide hydraulic access through the side entry sub S at P to the casing using the high pressure hose or piping and the high pressure pumping unit.

In any event, the fill and circulating assembly will be spaced below the attachment point T either on a top drive such that it will be located relatively similar to that shown with the elevator E in FIG. 1, when in operation. The same is true for a rotary rig since many adapters to the hook on a rotary rig have a side entry port for attachment to the rig mud system. In this position, the fill and circulating assembly will be inside the casing C when the casing C is positioned inside the elevator E such that the elevator E can be actuated to support the casing C. The heavy elevator E will position the casing C making stabbing the circulator assembly A into the casing C easier.

Figure 2:
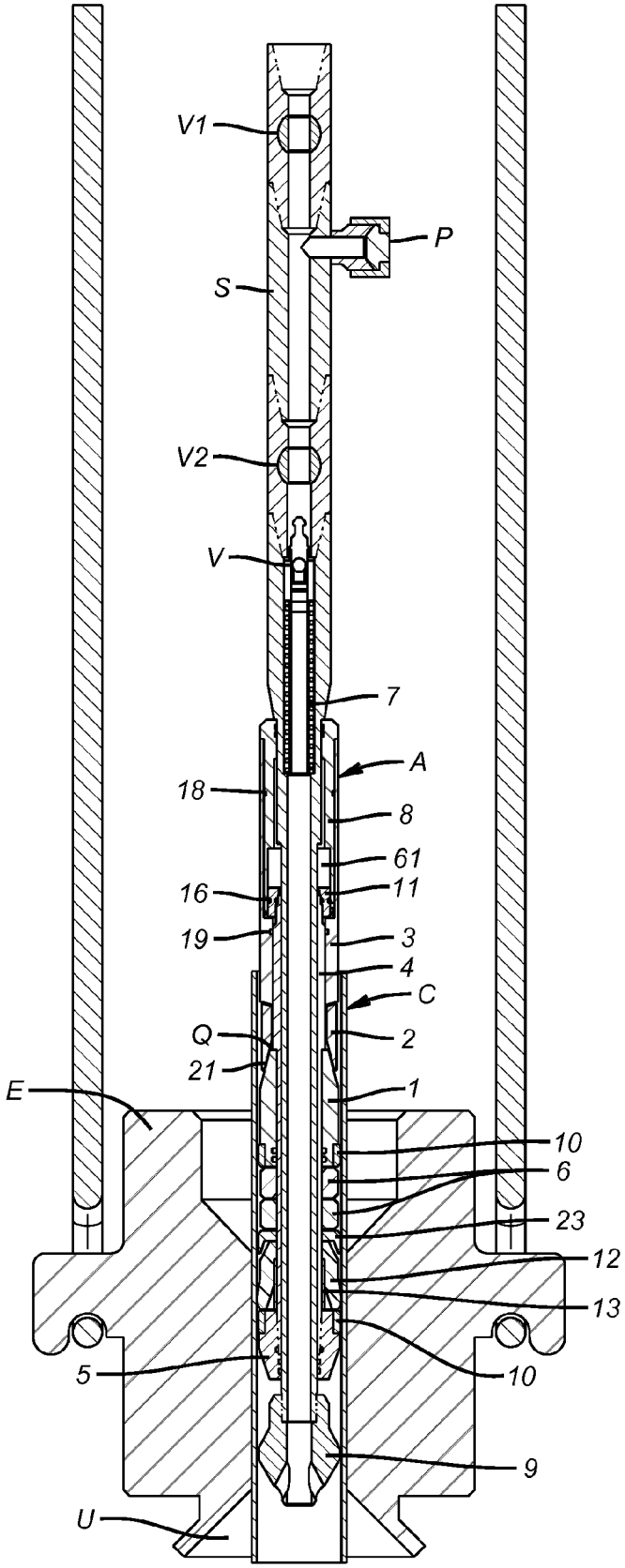
FIG. 2 is a partial cross sectional view taken along line 2-2 of FIG. 1.

In cross section of FIG. 2, the two safety valves V1 and V2 are shown in the open position, the fill-up and circulating assembly A is shown in the normal (released) position with the slips 3 and packer seals 6 retracted so they will not touch the casing so that the circulator A can be lowered into the casing C as the elevator E is lowered over the casing C.

Figure 2B:
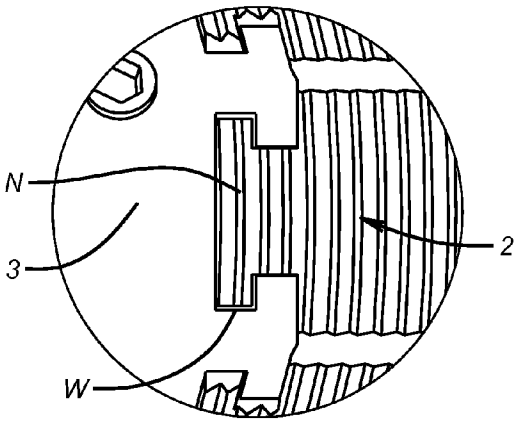
FIG. 2B is a detail view of the slip and slip housing attachment.
Figure 2A:
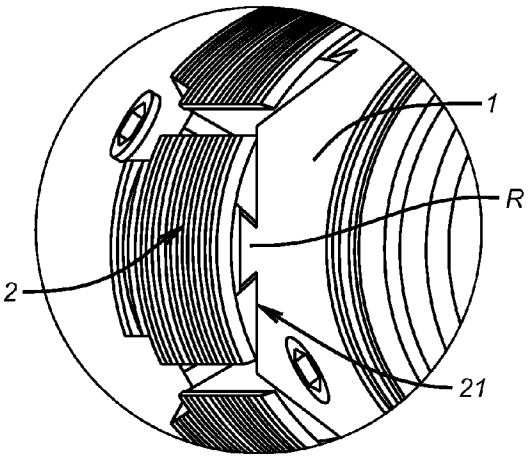
FIG. 2A is a detail view of the slip and cone attachment.

In FIG. 2A the toe of the slip 2 is illustrated with the groove in slip 2 engaged by the rail R of the cone 1. The groove in slip 2 and rail R on cone 1 control the slip 2 as it moves up and down the mating ramps 21 on cone 1 and slip 2. The mating faces 21 of cone 1 and slip 2 is an inclined plane which causes slip 2 to move outward or inward as cone 1 moves toward or away from slip 2.

In FIG. 2B the heel of slip 2 is illustrated with the tang N of slip 3 engaged with slot W of the slip housing 3. As slip 2 housing 3 moves toward or away from cone 1 slip 2 must follow the motion of slip housing 3.

Figure 2C:
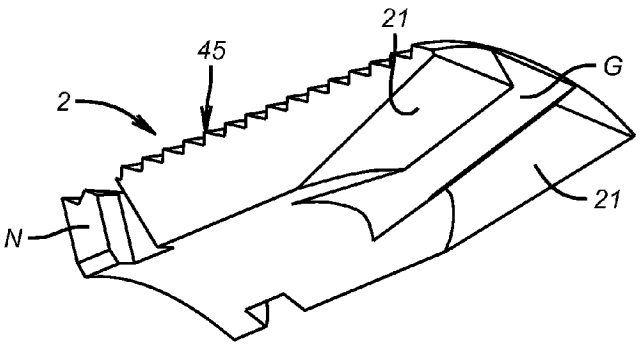
FIG. 2C is a view of the slip.

FIG. 2C is a bottom view of slip 2 showing mating face 21, Groove G, tang N and teeth 45. Teeth 45 provide an aggressive force holding capability when engaged with the casing.

Again with reference to FIG. 2, the relative position of the nose 9 of the fill-up and circulating assembly A is important. When the nose 9 is above the entry guide housing U of the elevator E, the normally large heavy elevator E will guide the casing C into the elevator E and subsequently over the fill and circulating assembly A. This is particularly important when the system is used on a floating drilling ship in high seas where it is difficult to stab the casing C into the elevator E since the casing C will be swaying with the motion of the floater, drill ship or platform.

The circulator A is shown with the addition of a cup type seal 12 at its lower end. The advantage of using the cup type seal 12 is that it requires no activation (seals when inserted into the casing C). In addition the cup type seal 12 will facilitate taking returns from the casing C without requiring the activation of the anchor and seal arrangement of the circulator A which will be explained later. The disadvantage of the cup type seal 12 is that its pressure holding capability is relatively low.

When used in this configuration it is possible to take returns from the casing C through the circulator A, valves V, V1 and V2 and to the rig mud system. It is also possible to fill or circulate the casing C at relatively low pressure using the rig mud system by pumping mud through the assembly and into the casing C.

Should it be necessary to withstand higher pressures the circulator A can be activated as will be discussed later.

The cup type seal 12 could be removed and replaced with a spacer that does not seal in the casing C. Also in this configuration air can escape from the casing C while each section of casing C is filled. In this configuration it is necessary to activate the circulator A causing the packer seals 6 and slips 2 to engage the casing inside surface anchoring and sealing the circulator A to the casing in order to circulate or take returns from the casing C.

Also shown in this view is a retrievable mud saver valve V disclosed previously in U.S. patent application "Self Aligning Mud Saver Valve Seat" Ser. No. 12/561,186 filed Aug. 13, 2010. Valve V will allow mud to fill the casing C when mud is being pumped and will prevent mud from falling out of the fill-up and circulating assembly A when the mud pumps are not pumping. The mud saver valve V also allows fluid to flow upward from the casing C. This valve also provides entry into the casing C under pressure using wire line, coiled tubing or other equipment when the center portion of valve V is retrieved since the internal parts of the valve V are retrievable.

For these discussions it is understood that the top drive (not shown) will hold the circulator A in the casing C while the top drive through the bails B and elevator E holds casing C in place.

The circulator A has a central passage formed by mandrel 7 and nose 9 threadedly attached at its lower end. Housing 8 is threadedly attached to slip housing 3. A T-shaped slot and tang as illustrated in FIG. 2B in the lower end of slip housing 3 retains slips 2. Slips 2 are also held in place by a rail R on cone 1 and groove G on the inner surface of the slip 2 illustrated in FIG. 2A. This arrangement illustrated in FIGS. 2A, 2B and 2C is commonly used in the industry and guides the slips 2 to a set position when slip housing 3 is moved closer to cone 1 and a released position when slip housing 3 is moved away from to cone 1. The slips 2 when in the set position will grip the casing C and prevent movement of the slips 2 relative to the casing C.

A hydraulic release chamber 61 is formed between seal nut 11, element mandrel 4, housing 8 and slip housing 3. Seals 16, 19 and 18 close this chamber. Hydraulic access to this chamber is through passage 60, which will be explained later.

Cone 1 is mounted on element mandrel 4 and is prevented from moving up relative to housing 3 by a shoulder Q between element mandrel 4 and cone 1. Packer elements 6, thimble 23, cup seal 12 and cup spacer 13 are mounted on element mandrel 4 and held in place by sub 5, which is threadedly attached to element mandrel 4. Packer elements 6 are an elastomeric component having a compressive modulus sufficient to prevent radial expansion of the packer element 6 until substantial axial force is applied, as will be explained later. Gage rings 10 centralize the circulator A in the casing C and the upper most gage ring 10 will prevent extrusion of the uppermost packer elements 6 when the casing C is pressurized. Thimble 23 prevents extrusion of the cup seal 12 and cup spacer 13 holds the cup seal 12 in place.

Figure 3:
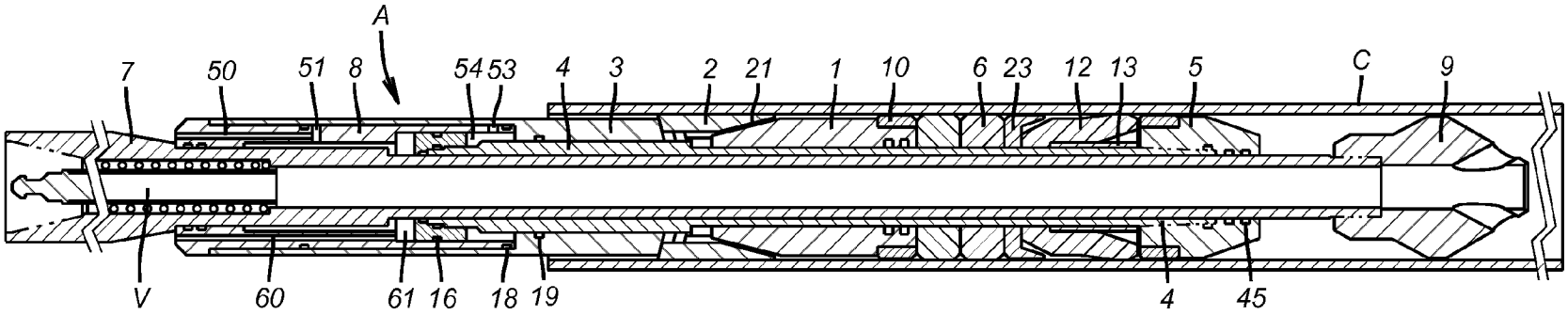
FIG. 3 is a cross sectional view showing the circulator in the casing, in the set position.

Referring now to FIG. 3, control of the circulator A is managed by the hydraulic control unit located at the rig floor (not shown) through at least one control line attached to passage 60 at the upper end of the circulator.

The fill-up and circulating assembly A is inserted in the casing C and in the set position as it would be as described above. In addition, a detail of the porting for the hydraulic release chamber 61 and the hydraulic setting chamber 54 can more easily be seen.

With constant pressure applied to release chamber 61 through passage 60 housing 8 is urged upward while seal nut 11 is urged downward, slip housing 3 is urged upward by housing 8 while seal nut 11 and element mandrel 4 are urged downward. The element mandrel will prevent cone 1 from moving upward so that these forces hold the slips 2 and packer elements 6 in the relaxed position. As the casing C is being filled there will be a very low pressure created since the casing mud level is kept some distance below the surface. In addition, when the circulator A is used to take fluid from the casing C while the casing C is being lowered (flow-back) this will be done at relatively low pressure as well. In these two cases the circulator A will remain in this the released position and can easily be inserted into the casing or removed.

The hydraulic release chamber 61 annular area formed by seals 24 and 16 and the pressure in the chamber provided from the hydraulic control system through a hose connected to passage 60 determines the force holding the element mandrel 4 in the down and released position. Pressure in the casing C will be acting on the annular area formed by the inside diameter of the casing C (at the outer extreme of the cup seal 12) and seals 21. When the force generated by the casing pressure exceeds the force generated in hydraulic release chamber 61 the element mandrel 4 will move upward setting slips 2. This occurs when (down force/up force) is somewhat greater than 1.0. At ratios higher than 1.0 sufficient upward force on the cup type seal 12 and element mandrel 4 will begin compressing and expanding packer elements 6. In this configuration the circulator A is automatic in its sequencing from unset to the set position and therefore from being low pressure capable because of the relative sealing capacity of the cup type seal 12, to the high pressure capability because of the high pressure capacity of the packer element seal 6. Stated another way, using the cup type seal 12 and pressure continuously applied to passage 60 and releasing chamber 61, the circulator A will remain in the released position until sufficient pressure is present below the circulator A in the casing at which time the circulator will move to the set position, sealing in and anchoring to the casing C. When the pressure below the circulator A in the casing decreases sufficiently the circulator A will return to the released position again. Also, with the cup type seal 12 and using this technique it is possible to use only one control pressure at passage 60 to release chamber 61, in other words only one control line would be used.

It is also envisioned that the control system and lines could be removed simply be placing an accumulator at the circulator A, attaching the accumulator to the rig hoisting system and porting the accumulator with a pre set pressure to passage 60 and release chamber 61 to operate the circulator A autonomously.

To manually operate the circulator A both control lines/hoses with pressure supplied from the hydraulic control system at the rig floor must be used. Again, the circulator A is inserted into the casing C while pressure is applied to passage 60 and into the release chamber 61 holding the circulator in the released position. Once the circulator A is properly positioned and the elevators E are set to hold the casing C, pressure in passage 60 and release chamber 61 would be released and a setting pressure applied to passage 50 and into setting chamber 54.

Pressure applied to passage 50 exits at port 51 through the annular area between the slip housing 3 and housing 8, then into port 53 and into the hydraulic setting chamber 54. It is easily seen that pressure applied to the setting chamber 54 will cause the circulator to move to the set position while pressure in the hydraulic releasing chamber 61 will cause the circulator to move to the released position.

It is also apparent that there is no need for a cup type seal 12 if the circulator A is used in the manual mode to take flow from the well (flow back), fill the casing and control a kick since the packer seals 6 in the unset position will allow mud to fill the casing below while allowing air to escape and setting the circulator through passage 50 and into setting chamber 54 will set the circulator, anchoring it to the casing C and sealing in the casing.

Summary of the operating modes of the circulator:

Automatic:

To operate in the automatic mode the cup type seal 12 must be used.

A constant preset pressure sufficient to release the circulator A is to be applied to the release port 60 and release chamber 61 by either a single hydraulic control line/hose with pressure supplied by the hydraulic control system located at the rig floor, or, by a hydraulic accumulator supplying the preset pressure, the accumulator can be attached to the rig hoisting system and output pressure attached to port 60.

In the automatic mode the circulator A can fill, circulate, take flow from the well (known as flow back) and can control a kick.

Manual:

Operation of the circulator A in the manual mode can be accomplished either with or without cup type seal 12.

Two hydraulic lines/hoses attached to the ports 50 and 60 with pressure supplied by the hydraulic control system located at the rig floor. One line/hose for releasing the circulator A through port 50 and the other for setting the circulator A through port 60.

In the manual operating mode the circulator A can fill, circulate, take flow from the well (known as flow back) and can control a kick.

I claim:

1. A fill up and circulating tool for running a tubular string from a surface to a subterranean location, comprising:

a housing having a passage therethrough;

said housing comprising relatively movable components with a primary seal connected thereto for engagement with an inner wall of the tubular string;

a selectively actuated sealing and gripping assembly on said housing and further comprising at least one secondary seal and at least one gripping slip positioned in the tubular string with said primary seal;

said secondary seal and gripping slip retained retracted with a predetermined pressure in a control system with said housing until such time as pressure on said primary seal from the tubular string overcomes said predetermined pressure so that said sealing and gripping assembly can be extended to contact the inner wall.

2. The tool of claim 1, further comprising:

a mud saver valve in said passage.

3. A fill up and circulating tool for running a tubular string from a surface to a subterranean location, comprising:

a housing having a passage therethrough;

a selectively actuated sealing and gripping assembly further comprising at least one seal and at least one gripping slip;

said seal and slip are both manually held retracted and are selectively manually hydraulically actuated with a piston in said housing;

said piston moves a portion of said housing to ramp said slip to the tubular string and compress said seal against the tubular string;

said housing comprises spaced valves in said passage with a side access into said passage between said valves through a wall of said housing.

4. The tool of claim 3, wherein:

said mud saver valve has components that can be removed from said passage to provide access for tools to pass through said passage.

5. A fill up and circulating tool for running a tubular string from a surface to a subterranean location, comprising:

a housing having a passage therethrough;

a selectively actuated sealing and gripping assembly further comprising at least one seal and at least one gripping slip;

said slip and seal are automatically actuated to contact the tubular string responsive to pressure in the tubular string;

said housing further comprises at least one additional seal to move at least a portion of said housing to actuate said slip and seal.

6. The tool of claim 5, wherein:

said lower seal comprises a packer cup.

7. The tool of claim 5, wherein:

said housing further comprises a piston to hold said seal and slip from contact with the tubular string.

8. The tool of claim 7, wherein:

pressure from the tubing string on said lower seal overcomes said piston's ability to hold said slip and seal retracted.

9. The tool of claim 8, wherein:

said seal and slip are both manually held retracted and are selectively manually hydraulically actuated with a piston in said housing.

10. The tool of claim 9, wherein:

said piston moves in opposed directions using pressure applied to control lines communicating to opposing faces of said piston.

11. The tool of claim 9, wherein:

said piston retracts said seal and slip with pressure provided on one side of said piston from a pressurized accumulator;

said seal and slip engage the string when pressure is vented from said accumulator.

12. The tool of claim 9, wherein:

said piston moves a portion of said housing to ramp said slip to the tubular string and compress said seal against the tubular string.

13. The tool of claim 12, wherein:

said housing comprises spaced valves in said passage with a side access into said passage between said valves through a wall of said housing.

14. The tool of claim 13, wherein:

said mud saver valve has components that can be removed from said passage to provide access for tools to pass through said passage.

* * * * *